US006577741B1

(12) United States Patent
Basore

(10) Patent No.: US 6,577,741 B1
(45) Date of Patent: Jun. 10, 2003

(54) METHOD AND ARTICLE OF MANUFACTURE TO ALIGN AND REINFORCE A DRIVER'S INSTALLATION IRRESPECTIVE OF DRIVER DIAMETER

(75) Inventor: William Tracy Basore, Fountain Hills, AZ (US)

(73) Assignee: Rockford Corporation, Tempe, AZ (US)

( * ) Notice: Subject to any disclaimer, the term of this patent is extended or adjusted under 35 U.S.C. 154(b) by 0 days.

(21) Appl. No.: 10/025,041

(22) Filed: Dec. 19, 2001

Related U.S. Application Data

(60) Provisional application No. 60/258,103, filed on Dec. 21, 2000.

(51) Int. Cl.[7] ..... H04R 25/00

(52) U.S. Cl. ..... 381/386; 381/391; 381/395; 181/150

(58) Field of Search ..... 381/386, 391, 381/395, 189, FOR 151, FOR 165; 181/150, 199

(56) References Cited

U.S. PATENT DOCUMENTS 4,277,653 A * 7/1981 Pawelzick ..... 181/150
4,853,966 A 8/1989 Skrzycki ..... 381/188
5,201,896 A 4/1993 Kruszewski ..... 248/278
5,206,464 A * 4/1993 Lamm et al. ..... 181/150
5,414,229 A 5/1995 Rocheleau et al. ..... 181/150
5,730,409 A 3/1998 Baron et al. ..... 248/292.12

* cited by examiner

*Primary Examiner*—Huyen Le
(74) *Attorney, Agent, or Firm*—Head, Johnson and Kachigian

(57) ABSTRACT

An apparatus and method to adjustably accommodate, align and reinforce an audio speaker's installation within a speaker enclosure irrespective of said speaker's diameter, the enclosure having an external mounting surface and a speaker aperture opening which abuts horizontal and vertical plane mounting surfaces for an enclosure ring, the speaker being insertable into and through said aperture from a front direction comprising an enclosure ring section having a hollow center portion, a surface mount portion and an insertion collar portion, said insertion collar portion extending perpendicularly from said surface mount portion; a mounting ring adjustably and removably mountable to the speaker and enclosure ring by fastening means with the mounting ring having a hollow center portion dimensioned to adjustably accommodate a speaker diameter.

5 Claims, 4 Drawing Sheets

METHOD AND ARTICLE OF MANUFACTURE TO ALIGN AND REINFORCE A DRIVER'S INSTALLATION IRRESPECTIVE OF DRIVER DIAMETER

REFERENCE TO PENDING APPLICATIONS

This application is a continuation in part of provisional application No. 60/258,103 filed Dec. 21, 2000. Said provisional application incorporates in its entirety herein by reference.

REFERENCE TO MICROFICHE APPENDIX

This application is not referenced in any microfiche appendix.

TECHNICAL FIELD OF THE INVENTION

In general, the present invention relates generally to an apparatus for positioning and installing audio drivers. In particular, the present invention relates to a method and article of manufacture to align and reinforce a driver's installation within a speaker enclosure irrespective of the driver's diameter.

BACKGROUND OF THE INVENTION

Consumers desire the ability to select a particular loudspeaker driver based upon its sound quality, price or other variable. These drivers are then mounted in a location referred to and embodied as an "enclosure" or "speaker enclosure". However, drivers vary with respect to mounting diameters, even where their nominal diameter is considered to be the same. Commonly, a driver referred to as a 10" driver will require a speaker enclosure mounting cutout, which varies in diameter from 8.8" to 9.4". Additionally, differences typically exist in the number and spacing of driver mounting screw locations.

Typically, the enclosure is sized to the smallest applicable diameter, and then enlarged by an installer to the correct size. Such enlarging is difficult, time consuming, and results in permanent modification to the mounting location.

An alternative solution is to size the mounting location to the largest required opening size, and to then utilize a variety of adaptors to accommodate variably sized drivers. To do so requires several different interchangeable adaptors. Further complicating matters, the adaptors must also provide for an airtight seal between the driver and the mounting location.

The instant invention is a multi-diameter loudspeaker mounting ring that can be quickly and easily modified to allow the use of a broad range of drivers without permanent modification to a mounting location, addresses varied screw mounting locations and quantity requirements, and provides an airtight seal between the driver and its mounting location.

BRIEF SUMMARY OF THE INVENTION

The instant invention is a multi-diameter loudspeaker of dimensioned enclosure which allows a single adapter to be quickly and easily modified to allow the use of a broad range of drivers, without permanent modification to the mounting location, addresses differing speaker screw mounting locations and quantity requirements, and provides an airtight seal between the driver and the mounting location; commonly referred to as a speaker/driver enclosure.

Consequently it is a primary object of the instant invention to provide a single apparatus which can be quickly and easily modified to allow the installation and use of a broad range of drivers absent need to permanently modify the mounting location.

It is a further object of the instant invention to accommodate differing screw mounting locations and driver quality requirements while providing an airtight seal between the driver and mounting location.

Yet another object of the instant invention is to provide for the improved positioning, reinforcement and alignment of the driver within a driver mounting location.

Additional objects and advantages of the invention are set forth, in part, in the description which follows and, in part, will be apparent to one of ordinary skill in the art from the description and/or from the practice of the invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference would be had to the accompanying drawings, depictions and descriptive matter in which there is illustrated preferred embodiments and results of the invention.

DESCRIPTION OF THE DRAWINGS

FIG. 2 is an exploded view, cross-sectional diagram of the instant invention showing structural components and component relationships of the instant invention when practiced in its preferred embodiment. FIG. 2A is a cross-sectional view of the instant invention shown installed within a speaker enclosure.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

Figure 1:
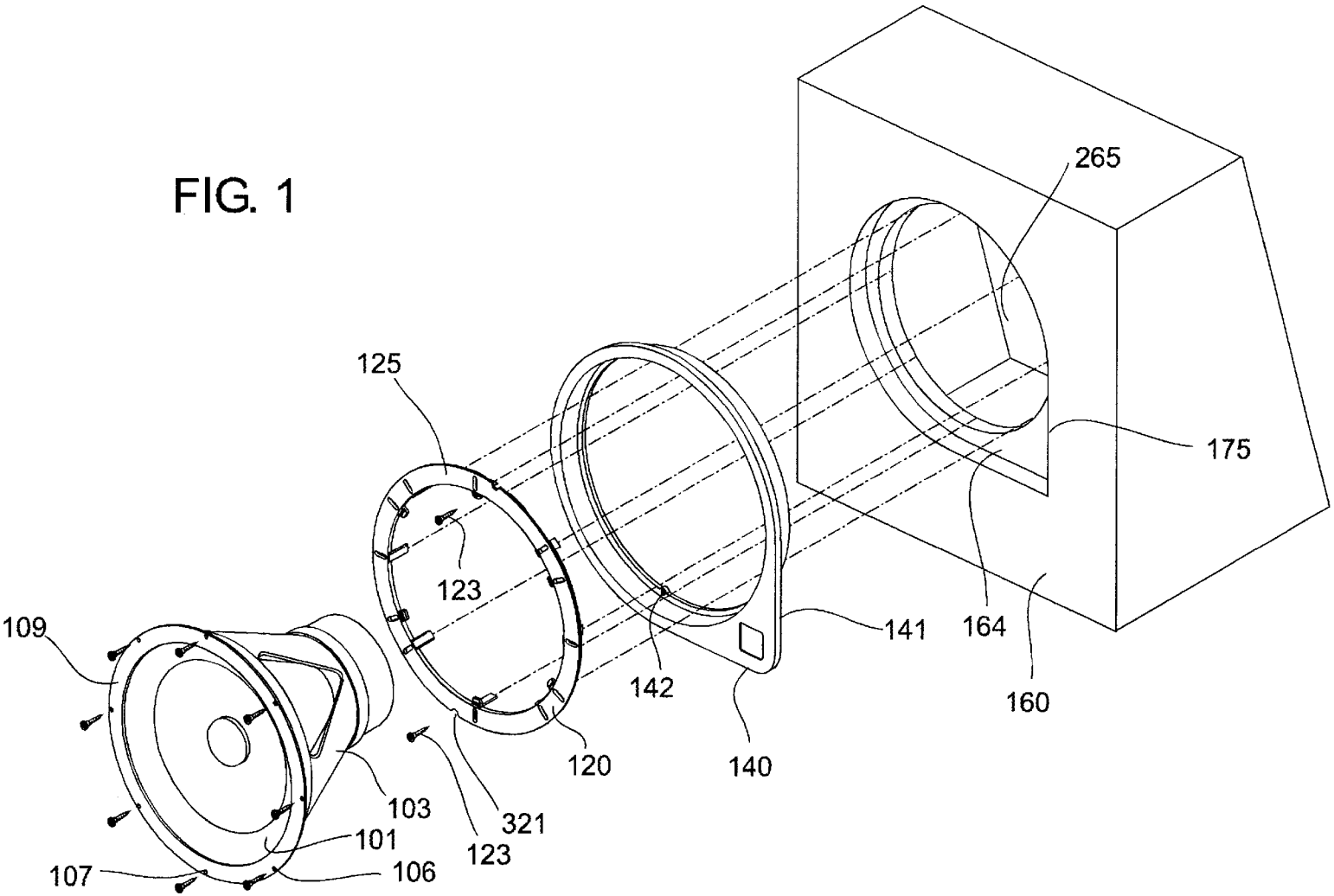
FIG. 1 is a exploded view diagram of the structural components of the instant invention as practiced in its preferred embodiment.

FIG. 1 illustrates an exploded view diagram of the structural components of the instant invention as practiced in its preferred embodiment. Turning now to FIG. 1.

Figure 2:
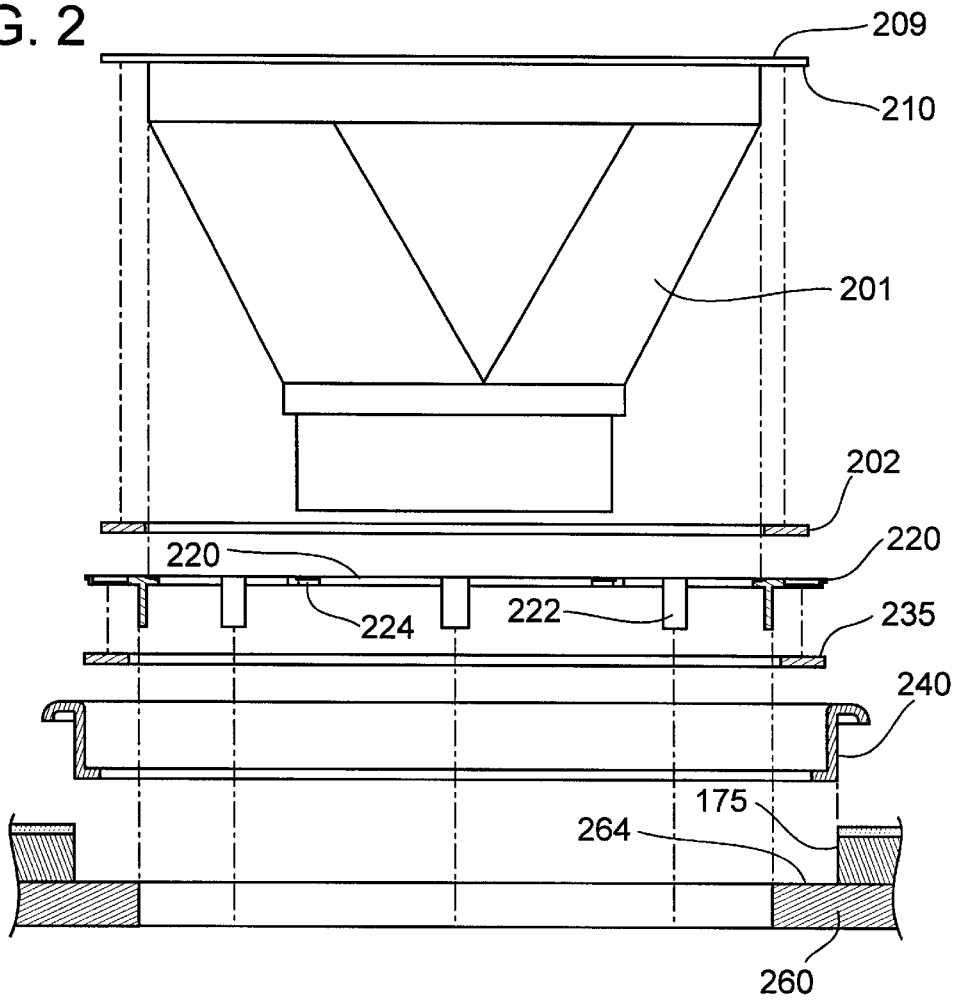
FIG. 2 and FIG. 2A are cross-sectional diagrams of the instant invention when practiced in its preferred embodiment.

In FIG. 1 a speaker 101 (herein referred to synonymously as "driver") is shown. The driver 101 is first provided with insulating tape adhesively secured to the underlip of the driver's forward most surface 109. Further detail and disclosure with respect to placement of said insulating tape is provided and discussed in association with FIG. 2. The driver is placed through a center portion of a mounting ring 120, having a surface mount portion 141 and an insertion collar portion with the forward most surface of said mounting ring 125 placed in communication with insulation tape (not shown) located on the opposite side of the driver's forward most surface 109. A second application of insulating tape is then applied to the underside (a/k/a opposite side) of said mounting ring's forward most surface 125. The mounting ring of the instant invention 120 and driver 101 are then inserted through an open center portion of enclosure ring 140, and said driver 101, mounting ring 120, and enclosure ring 140 placed within an appropriately dimensioned driver enclosure 160. Said driver enclosure 160 typically embodies a stylized cutout section 175 and providing a driver orifice 265 capable of accommodating the insertion therethrough of said driver 101 cone-like structure 103. The enclosure 160 typically, though not limitedly, also embodies a cutout section providing a vertical plain mounting surface 164 to which said enclosure ring 140 and said mounting ring 120 are removably attached via mounting screws 106 and 123 respectfully. FIG. 2 provides greater detail with respect to the interrelationships and placement of structural elements comprised in the instant invention as practiced in its preferred embodiment. Turning now to FIG. 2.

Figure 2A:
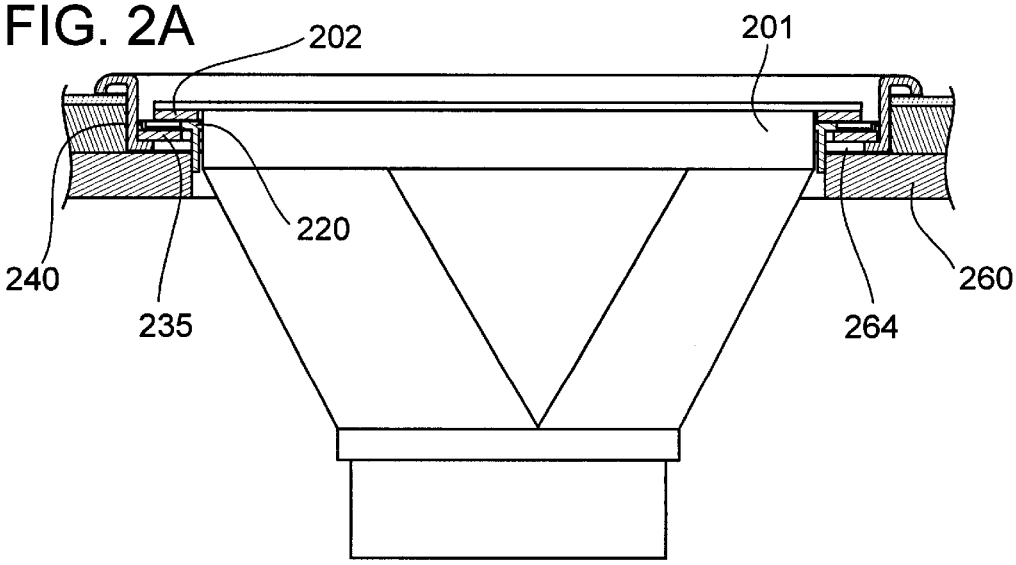
Figure 3:
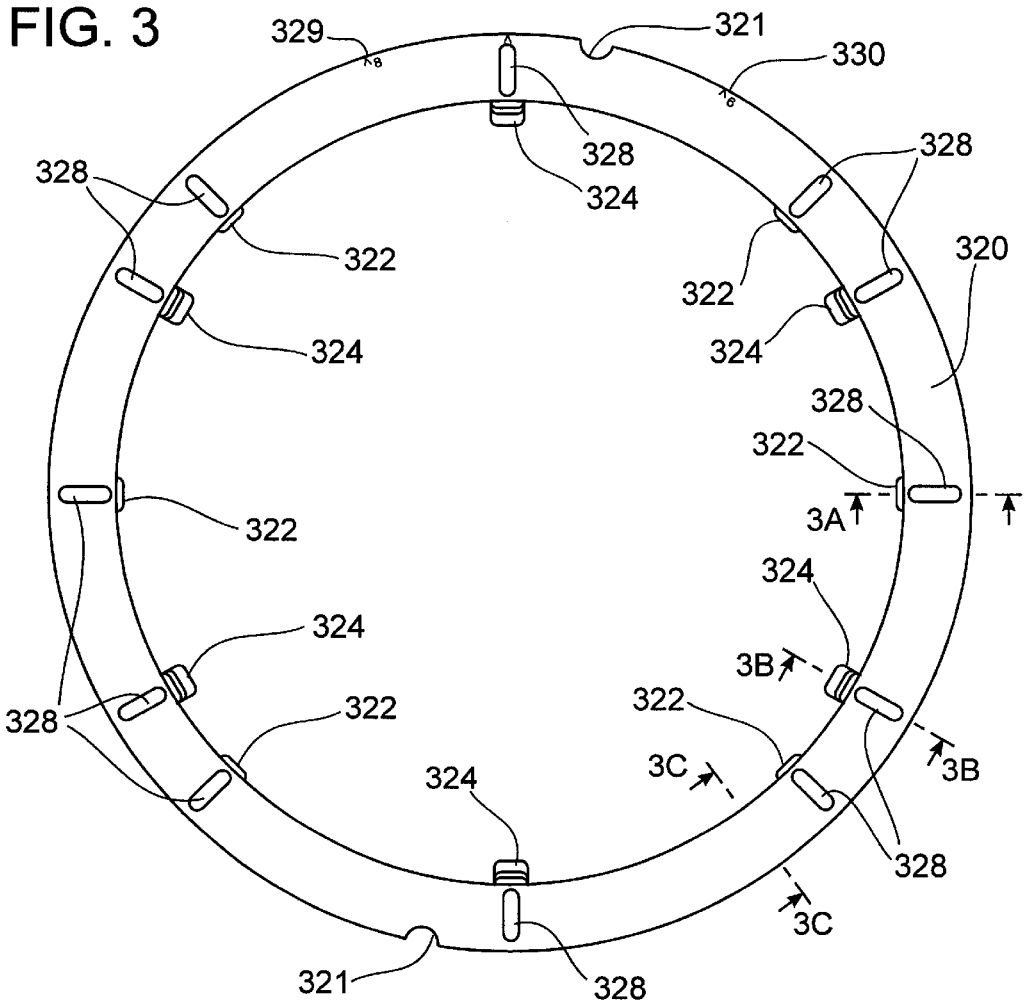
FIG. 3 is a top view illustration of the mounting ring of the instant invention providing further detail with respect to elements embodied within and thereupon.

In FIG. 2, the speaker of the instant invention 201 is shown in communication with adhesive/insulating tape 202. Said tape 202 positioned between the underside lip 210 of the speaker's forward most surface 209 and the mounting ring 220. In FIG. 2, a cross sectional representation of the invention's centering tabs 224 and locating tabs 222 may also be observed. On the underlip 217 of said mounting rings forward most surface 219, adhesive insulation tape 235 is placed and positioned between the said mounting ring 220 and enclosure ring 240. The assemblage of said driver 201, insulating tape 202, mounting ring 220, insulation tape 235, and enclosure ring 240 are shown positioned within an appropriately dimensioned and designed cutout section 263 of enclosure 260. FIG. 2A illustrates placement of said assembled elements as shown attached to and within speaker enclosure 260. FIG. 3 provides greater detail with respect to the mounting ring of the instant invention. Turning now to FIG. 3.

Figure 3A:
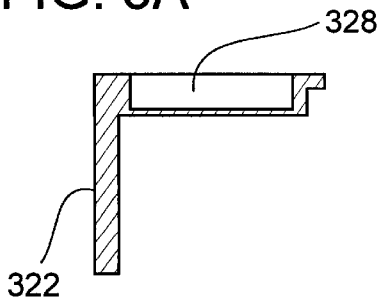
FIGS. 3A, 3B, and 3C illustrate cross-sectional side view illustrations of the mounting ring of FIG. 3 providing further detail with respect to the positioning of the invention's locating and centering tabs.
Figure 3B:
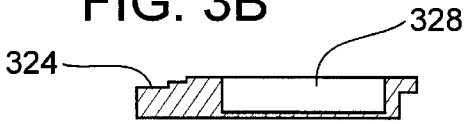
Figure 3C:
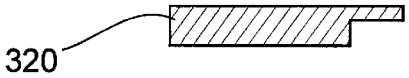

In FIG. 3, the mounting ring of the instant invention 320 is shown as are template demarcation indicators 329 for aligning and mounting an 8 screw speaker attachment configuration, and 330 for a 6 screw speaker attachment. Said demarcation indicators 329 and 330 sized and aligned with corresponding indicators positioned and indicated on enclosure ring (ref. 140 FIG. 1, 240 FIG. 2). Also shown in illustration 3 are enclosure ring attachment accommodations 321, mounting screw recesses 328 through which screws attach speaker and mounting ring to the speaker enclosure, centering tabs 324, and location tabs 322. FIG. 3A is a cross sectional representation of the mounting ring 320 of the instant invention providing further detail with respect to locating tabs 322 and mounting screw recesses 328. FIG. 3B illustrates structural relationships of the center tab 324 of the instant relationship with respect to positioning relationship to said mounting screw recess 328. FIG. 3C illustrates a cross sectional view of the mounting ring of the instant invention 320 in those areas absent mounting screw recess 328, centering tab 324, or locating tab 322 structural elements.

Figure 4:
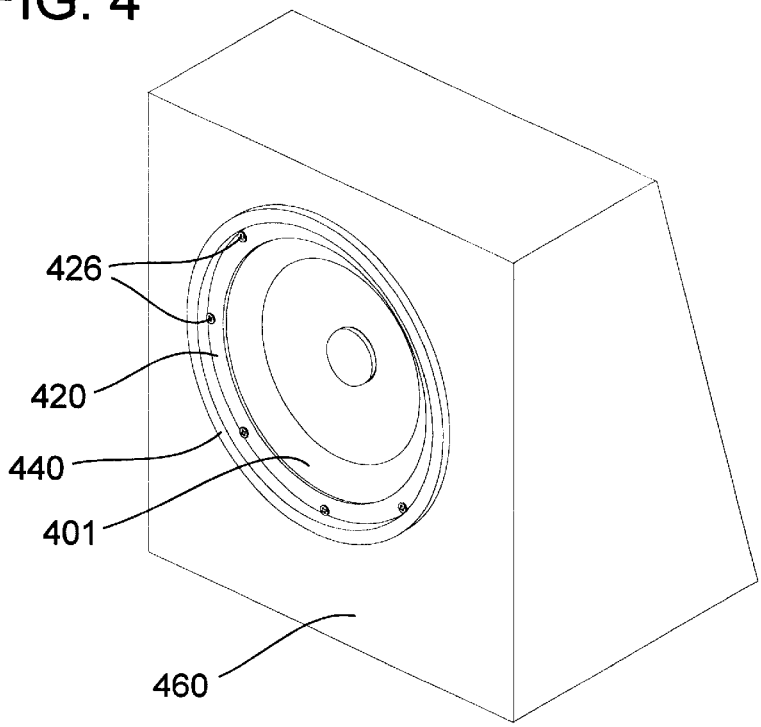
FIGS. 4 and 4A illustrate an alternative embodiment of the instant invention wherein a uniformly circular mounting ring has been utilized to facilitate insertion of a driver within a driver enclosure.
Figure 4A:
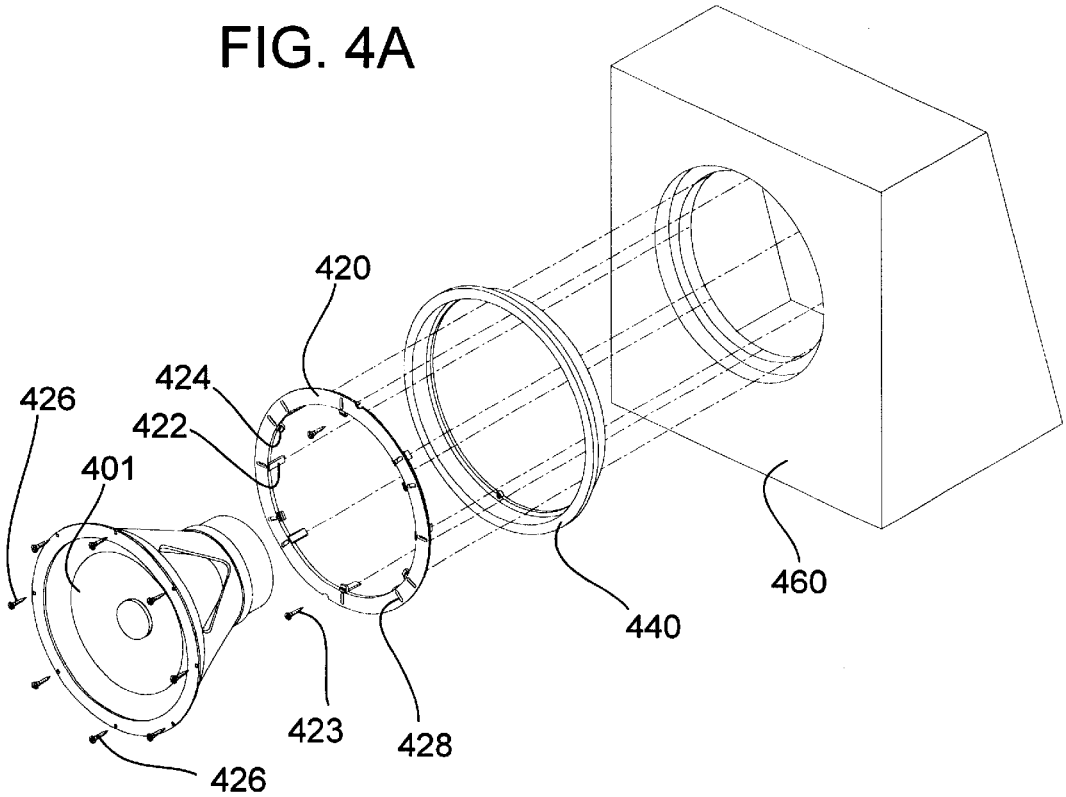

FIG. 4 and FIG. 4A illustrate an alternative embodiment of the instant invention wherein the mounting ring 440 of the instant invention is absent stylized appendage requiring accommodation within or on the mountable surface area of speaker 460.

There are several unique aspects of the instant invention which contribute to its utility. The benefits of each unique aspect as presented herewith is to be considered individually as well as their effect in combination with one another.

Aspect: Centering Tabs

Centering the driver within the opening is critical because the driver is attached to the mounting location by screws that pass thru the outside perimeter of the frame of the driver. Typically, the driver is not visible from the backside following its insertion into the mounting location. Therefore, the driver conceals the degree to which it has been centered in the mounting location. If the frame is offset to one side of the mounting location the screws on the opposite side may fall within the opening of the mounting location, and thereby fail to provide attachment of the driver to the mounting location.

Evenly spaced around the inner circumference of the device are a plurality of centering tabs 324 that extend into the center of the opening. Where a minimal diameter driver is used, these tabs serve to center the driver within the opening. The tabs 324 bear marks that indicate the degree to which they need to be trimmed to allow the use of progressively larger diameter drivers. Ultimately, the tabs are trimmed away entirely where the largest diameter driver is being used.

Aspect: Locating Tabs

The smaller diameter drivers also pose an additional concern. In many cases, the diameter of the screw mounting circle decreases along with the required mounting hole diameter. This tends to place the mounting screws quite close to the edge of the mounting hole cutout. Where they are very close, this can lead to failure of the mounting location material by breaking out into the mounting hole. In particular, where the mounting location is made of a wood based material, it will commonly split, or blow out into the mounting hole.

In order to reinforce the mounting location at the screw locations, there are locating tabs 322 positioned perpendicular to the centering tabs extending downward into the mounting hole at each mounting screw location. These tabs 322 serve to provide additional resistance to material failure of the mounting location. These tabs are ultimately trimmed away when the largest diameter driver is installed where their utility is no longer required.

Aspect: Screw Alignment Slots

Many drivers feature decorative designs on the dust cap, cone or other areas on the face of the driver. To insure that the design is oriented properly relative to the mounting location, it is desirable to provide an indexing system. These designs are typically indexed to the screw mounting locations at the perimeter of the driver. Drivers typically have four, six or eight screw locations evenly spaced around the outer perimeter of the frame of the driver. These screw locations may be indexed to either align a true compass point configuration, or in some cases straddle the compass points. For example, in the case of a four-hole mounting system, holes might be located at the twelve o'clock position, the three o'clock position, the six o'clock position, and the nine o'clock position. Alternatively, the first mounting location could be shifted by 45 degrees to the one-thirty position, with the balance of the locations moving clockwise by forty-five degrees, as well.

The invention features molded-in screw locations as follows: Starting at the twelve o'clock position, there are eight slots arrayed in a radial pattern about the perimeter of the device at forty-five degree intervals. Coinciding with the first and fifth of the eight slots, there are six slots at sixty degree intervals. The combination of these two sets of slots allows for four, six, or eight screw mounting of the driver. Rotation of the adapter ring twenty-two and a half degrees will result in the eight-hole configuration straddling the compass point configuration. Rotation of the adapter ring by thirty degrees will result in the six-hole configuration straddling the compass point configuration.

To further insure proper alignment, the adapter ring has a registration tab which can be aligned with a series of registration points either integral to the mounting location or located in an external surrounding component.

The molded-in screw mounting locations do not completely perforate the adapter ring. Unused screw mounting locations can provide a path for possible air leaks. By leaving a thin layer of material intact within the adapter ring this path is effectively blocked.

Aspect: Driver Sealing

The adapter ring may be produced in a compliant material that would also provide an effective gasket for sealing the driver to the mounting location. Alternatively, secondary gasket materials maybe used with an adapter produced from a non-compliant material.

Aspect: Driver Attachment Clamps

Where the diameter of the woofer mounting screws is too small to allow the screws to effectively penetrate the driver mounting location (they fall too close to the edge of the mounting hole), a set of clamps provides a mechanism to move the mounting screw outside the perimeter of the driver with the clamp extending in a cantilevered manner from the outboard screw location over the outside edge of the driver.

The described device may include all of the described features to provide the following benefits:

Centering of the driver within the mounting location, reinforcement of the material surrounding the mounting hole within the mounting location, A method of attachment of the driver even where the screw diameter is inadequate for conventional attachment, alignment of the driver with the mounting location in a variety of different configurations, and sealing of the driver to the mounting location. This may be accomplished with or without an accompanying surrounding component.

Alternatively, each feature could be utilized individually or in any combination of the other feature components.

The surrounding component may also serve to provide an attachment location for a protective grill covering the face of the driver.

The invention's mounting ring centers the woofer or speaker into the enclosure opening to ensure even spacing all the way around. The invention's locating tabs (hereafter referred to synonymously as reinforcing tabs) extend the woofer opening to keep blowout to a minimum. As used herein, the term blowout relates to the insertion of a screw into a wood or composite base wherein sufficient density cannot be had to contain the inserted screw; thus, resulting in a "blowout" of one or more areas immediately adjacent the inserted screw.

Guide slots embodied within the mounting ring assist in directing screws away from a woofer hole cut out. With larger woofers, centering tabs can be trimmed to fit with such tabs featuring molded insteps to easily facilitate moving the same amount from each tab; thus, ensuring woofer centering accuracy.

A woofer is installed using the apparatus of the instant invention by one first preparing the driver an mounting ring. In so doing, foam tape is first applied to the back of the driver ensuring that the application of foam tape covers all mounting holes associated with the driver of reference. The mounting ring should then be placed face down with locating tabs extending vertically in an upward direction. Foam (a/k/a insulating) tape is then applied to the back of the mounting ring and against its inside most edge. The driver (a/k/a speaker) should then be placed face down on a flat surface. The mounting ring is then placed over the driver, with the locating tabs extending upward in a vertical direction. Should the mounting ring not be able to rest on the foam tape of the driver, the centering tabs of the mounting ring must be trimmed. Utilizing a pair of diagonal cutters or scissors, each of the centering tabs of the instant invention are trimmed appropriately and the sizing of the speaker within the mounting ring is again re-verified. Once the mounting ring fits against the foam tape of the driver, the driver is ready to be mounted into the enclosure. The mounting ring is then inserted into the enclosure ring of the invention, and arrows on the mounting ring are aligned with alignment marks on the enclosure ring. For 8 hole offset alignment, use the appropriately indicated 8 hole offset alignment locators. For 6 hole offset alignment, use the position for mounting drivers with 6 hole offset alignment. The mounting holes of the driver should then be aligned with the recesses in the mounting ring. If necessary, the mounting ring and the driver may be rotated to properly align any non-circular appendages embodied within the construct of the enclosure ring.

It will be apparent to those skilled in the art that various modifications and variations can be made in the construction, configuration, and/or operation of the present invention without departing from the scope or spirit of the invention. For example, in the embodiments mentioned above, variations in the materials used to make each element of the invention may vary without departing from the scope of the invention. Thus, it is intended that the present invention cover the modifications and variations of the invention provided they come within the scope of the appended claims and their equivalents.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An apparatus to adjustably accommodate, align and reinforce an audio speaker's installation within a speaker enclosure irrespective of said speaker's diameter, the enclosure having an external mounting surface and a speaker aperture opening which presents horizontal and vertical plane mounting surfaces for an enclosure ring, the speaker being insertable into and through said aperture from a front direction comprising:

an enclosure ring section, having a hollow center portion, surface mount portion and an insertion collar portion, said insertion collar portion extending perpendicularly from said surface mount portion; and a mounting ring adjustably and removably mountable to the speaker and enclosure ring by fastening means, the mounting ring having a hollow center portion dimensioned to adjustably accommodate a speaker diameter, the fastening means being securable to the speaker from the front.

2. The apparatus of claim 1 wherein said mounting ring further comprises:

a plurality of centering tabs positioned along the innermost surface of said mounting ring and extending towards the center of said ring's hollow center portion;

a plurality of locating tabs center positioned along the innermost surface of said mounting ring and extending downwardly in a direction perpendicular to that of said centering tabs;

a plurality of mounting screw recesses;

a plurality of template demarcation indicators; and at least one enclosure ring attachment accommodation.

3. An apparatus to adjustably accommodate, align and reinforce an audio speaker's installation within a speaker enclosure irrespective of said speaker's diameter, the enclosure having an external mounting surface and a speaker aperture opening which presents horizontal and vertical plane mounting surfaces for an enclosure ring, the speaker being insertable into and through said aperture from a front direction comprising:

an enclosure ring section, having a hollow center portion, surface mount portion and an insertion collar portion, said insertion collar portion extending perpendicularly from said surface mount portion; and a mounting ring adjustably and removably mountable to the speaker and enclosure ring by fastening means, the mounting ring having a hollow center portion dimensioned to adjustably accommodate a speaker diameter;

a plurality of centering tabs positioned along the innermost surface of said mounting ring and extending towards the center of said ring's hollow center portion;

a plurality of locating tabs center positioned along the innermost surface of said mounting ring and extending downwardly in a direction perpendicular to that of said centering tabs;

a plurality of mounting screw recesses;

a plurality of template demarcation indicators; and at least one enclosure ring attachment accommodation.

4. The apparatus of claim 2 wherein the plurality of mounting screw recesses do not completely penetrate the mounting ring such that unused mounting screw recesses do not provide holes through the mounting ring.

5. The apparatus of claim 3 wherein the plurality of mounting screw recesses do not completely penetrate the mounting ring such that unused mounting screw recesses do not provide holes through the mounting ring.

* * * * *